US007469479B2

(12) United States Patent
Jager

(10) Patent No.: US 7,469,479 B2
(45) Date of Patent: Dec. 30, 2008

(54) METHOD FOR MEASURING TRACKS

(75) Inventor: Heinz Jager, Volketswil (CH)

(73) Assignee: J. Müller AG, Effretikon (CH)

( * ) Notice: Subject to any disclaimer, the term of this patent is extended or adjusted under 35 U.S.C. 154(b) by 125 days.

(21) Appl. No.: 11/587,038

(22) PCT Filed: Apr. 21, 2004

(86) PCT No.: PCT/CH2004/000241

§ 371 (c)(1),
(2), (4) Date: Oct. 20, 2006

(87) PCT Pub. No.: WO2005/103385

PCT Pub. Date: Nov. 3, 2005

(65) Prior Publication Data

US 2007/0213926 A1 Sep. 13, 2007

(51) Int. Cl.
*E01B 35/00* (2006.01)

(52) U.S. Cl. ..... 33/1 Q; 33/287; 33/651

(58) Field of Classification Search ..... 33/1 Q, 33/287, 338, 651, 651.1, 523.1, 523.2, 521
See application file for complete search history.

(56) References Cited

U.S. PATENT DOCUMENTS

| | | | | |
|---|---|---|---|---|
| 3,821,932 | A | 7/1974 | Theurer et al. | |
| 5,203,089 | A * | 4/1993 | Trefouel et al. | 33/338 |
| 5,331,745 | A | 7/1994 | Jager | |
| 5,786,750 | A * | 7/1998 | Cooper | 340/425.5 |
| 6,415,522 | B1 * | 7/2002 | Ganz | 33/523.1 |
| 6,634,112 | B2 * | 10/2003 | Carr et al. | 33/287 |
| 6,725,782 | B1 * | 4/2004 | Bloom et al. | 33/1 Q |
| 7,181,851 | B2 * | 2/2007 | Theurer et al. | 33/1 Q |
| 2004/0173033 | A1 * | 9/2004 | Gilbert | 33/1 Q |
| 2006/0059697 | A1 * | 3/2006 | Theurer et al. | 33/1 Q |

FOREIGN PATENT DOCUMENTS

| | | |
|---|---|---|
| DE | 1244824 | 7/1967 |
| DE | 19652627 | 6/1998 |
| DE | 19755324 | 6/1999 |
| EP | 0559850 | 5/1996 |

OTHER PUBLICATIONS

English Abstract of DE 19652627.
English Abstract of DE 19755324.

* cited by examiner

*Primary Examiner*—Yaritza Guadalupe-McCall
(74) *Attorney, Agent, or Firm*—Dykema Gossett PLLC

(57) ABSTRACT

The invention relates to a method for measuring tracks in relation to a measuring plan of the track which contains the actual position of the track, in relation to an absolute coordinate system. A measuring platform (2) is guided along the track (1), whereon an inertia platform (6) is arranged, which is initialised, respectively, calibrated to the beginning of the measurement and is aligned in relation to the coordinate system. The inertia platform (6) detects the respective positions of the measuring platform (2) in relation to the coordinate system during the journey of the measuring platform (2). Positional data of the inertia platform (6) is periodically examined based on fixed points (9; 9') which are arranged in the vicinity of the track and deviations in relation to the coordinate system are corrected by novel calibration, respectively, alignment.

20 Claims, 3 Drawing Sheets

METHOD FOR MEASURING TRACKS

BACKGROUND OF THE INVENTION

Field of the Invention

The present invention relates to a surveying method.

To maintain or newly construct tracks/roadways, such as, e.g., streets or railroad tracks, it is crucial that the course of a track/roadway is exactly surveyed, compared to a desired course, and afterwards corrections that may be needed are implemented using track construction laying machinery that is suitable for this purpose.

As a matter of principle, when using the corresponding measuring means, it is possible to measure with great precision the course of the track/roadway from outside of the track/roadway in relation to geographic reference points. But these are static measurements for which it is necessary, if larger sections of track/roadway are to be surveyed, that the measurement site next to the track/roadway must, respectively, be newly set up, calibrated and the measurement taken. Measuring processes of this kind are not suited, in particular, for controlling continually operating track construction laying machines whose task it is to correct, if need be, the course of the track/roadway in relation to the preset desired course. Track construction laying machines of this kind depend on an, to the extent that this is possible, continual and current measurements of the current course of the track/roadway directly in the working area of the track construction laying machine in order to allow for these tasks to be completed within the shortest possible amount of time with optimally possible precision.

A method of this kind for the track maintenance of railroads is known, for example, from EP 0 559 850. In this instance, a measuring platform that can be rolled on the tracks is used; it is equipped with optical means that serve to detect position change values of the measuring platform by way of reference points that are arranged next to the tracks. These values are converted to position data and compared to the desired values of a stored survey plan. The deviation between these values presets correction values that can be evaluated by a special track maintenance construction machine in order to be able to correspondingly make corrections to the course of the track. Using a single measurement base, which can preferably be coupled directly ahead of the track maintenance construction machine, it is possible to continually detect and implement the values.

In order to arrive at absolute values for the track maintenance construction machine based on these changes, the position of the measuring platform must be established in absolute terms before the beginning of the measurement with said measuring platform. This is done by way of a separate, static position determination at the beginning of the measurement. Even though the optical measurement achieves very high accuracy, it cannot be implemented under all conditions, due to the requirement for a continuous optical connection between the measuring platform and the reference points. For example, environmental influences such as fog or elements that interrupt and/or disrupt the view, such as construction machinery or workers, may thus lead to measuring errors or may make a measurement impossible altogether.

The object of the present invention consists in providing a measuring method that will allow for a reliable and precise detection of the position change of the measuring platform and thereby of the track course without requiring a continuous connection to the reference points and to allow for continual use of the method also across longer stretches and/or distances while maintaining a high level of precision.

SUMMARY OF THE INVENTION

This object is achieved according to the invention by way of a method for surveying tracks/roadways in relation to a survey plan of the track/roadway, which contains the desired position of the track/roadway in relation to an absolute system of coordinates, provides that the position data of the inertia platform in relation to the system of coordinates are automatically checked and any deviations with regard to the system of coordinates are detected as correction values, and these are used for the correction of the measured data and/or the measured actual position of the measuring platform. To this end, a measuring platform is rolled along the track/roadway which has arranged thereon an inertia platform that is initialized and/or calibrated at the beginning of the measurement and aligned in relation to the system or coordinates; and the inertia platform records, during the travel of the measuring platform, the respective positions of the measuring platform in relation to the system of coordinates.

By using an inertia platform, which is periodically calibrated in relation to the system of coordinates, i.e. its position data is corrected with regard to the system of coordinates, it is possible to continually detect and record with great precision the position of the measuring platform. The advantage of the inertia platform lies in the fact that it provides very precise values virtually irrespective of weather conditions, and that it can be universally used anywhere. Thanks to the periodic position data checks of the inertia platform relative to their effective position in relation to the system of coordinates, it is possible to continually and quickly recognize any deviation of the platform from the actual position and to take these values into account as correction values when calculating the position data.

Preferably, the periodic check of the position data of the inertia platform is done by way of an optical surveying of the position of the measuring platform in relation to the fixed points that are arranged adjacent to the track/roadway. This allows, respectively, for a very precise determination of the actual position of the measuring platform, and any values of the inertia platform deviating from this can be corrected. Since, in contrast to conventional systems, the optical measurement does not have to be effected continually but instead only periodically and at defined sites, this optical measurement is considerably less easily impacted by outside influences, such as e.g. obstacles that hide the view of the fixed points. If need be, it is even possible to forego such a measurement, if such a measurement is not able to deliver precise results; in such a case the measurement, and if need be any correction, is implemented at the next fixed point.

Used, preferably, as inertia platform is a gyrostabilized platform or a laser platform. In this context, the laser platform usually has the higher level of precision and a smaller drift, i.e. a smaller deviation from the actual position after calibration, than the gyrostabilized platforms, which in turn are cheaper to buy and provide a sufficiently high level of precision for tracks/roadways with only minimal directional changes.

Preferably, the measuring platform is additionally equipped with a satellite-supported navigational system; here, the position data of the inertia platform are compared to the position data of this navigational system. If there are any deviations of these position data between each other, corrected position data are calculated and stored. This way, the continual adjustment and/or correction of the position data originating from the inertia platform is even possible between two fixed points, whereby the precision of the method is further improved overall.

Preferably, the position data of the satellite-supported navigational system are also periodically checked in relation to their effective position relative to the system of coordinates and, if deviations have occurred, correspondingly corrected. Moreover, it is possible to correct the position data of the satellite-supported navigational system by including values of a second navigational system that is positioned as defined in relation to the system of coordinates, whereby the precision of the results can be further improved.

Preferably, any deviations of the position data of the inertia platform that are determined at a fixed point are applied linearly to the previously measured points in the sense of a correction. The position values of the measuring platform that were previously detected and stored can be corrected after the fact, if there is a deviation found at a fixed point. Thus, the correction is advantageously applied linearly with regard to the position values relative to the distance of the previous fixed point. This way it is possible, for example, to determine and, if need be, record the actual course of a track/roadway in relation to the system of coordinates and thereby also with regard to the desired course of the survey plan.

Preferably, the measuring platform is connected to reference platforms that can also be rolled along the track/roadway and that follow the course of the track/roadway; the position of the reference platforms can be detected in relation to the measured platform by way of optical means and used to supplement or correct the measured and/or calculated values. Thanks to these additional relative reference points, it is possible, for example, to detect and determine the curve radius of the track/roadway with great precision. Used for this purpose are, preferably, two reference platforms that are sequentially arranged and connected to the measuring platform at a constant, defined distance.

Preferably, the reference platforms are equipped with optical reflectors, and at least one light scanner is used on the measuring platform. The light scanner communicates optically with the reflectors and can very exactly detect the reflectors' relative angle-related deviations, for example in relation of the longitudinal axis of the measuring platform. It is therefore possible to arrive at a very exact determination of, for example, the curve radius of a track/roadway by relying of the known geometrical relations between measuring platform and reference platforms.

Preferably, the method according to the invention is used for measuring railroad tracks. Defined conditions are applicable especially in that area, in particular with regard to the alignment of the measuring platform wherefore the latter is able to detect the course of the mid-line and, by detection of the incline in relation to the horizontal, also the course of the two parallel track lines.

Preferably, the deviations of the raw or corrected position data from the desired position are fed directly as control data to a track construction laying machine that follows the measuring platform or that is directly connected to the measuring platform in order to adjust the track to the desired position. The measuring platform can advantageously be coupled ahead of a track working machine, or it can even be arranged on top thereon and/or integrated therewith and trigger such a machine in order for the course of the track/roadway to be adjusted to the desired course. This process allows for continual and quick track work. This is especially crucial when working with railroad tracks because track work can usually only be conducted during down-times when trains are not operating, and these times are shrinking more and more in view of longer and longer operating times.

An embodiment of the method according to the invention is subsequently described by way of the figures.

DETAILED DESCRIPTION OF THE PREFERRED EMBODIMENT

Figure 1:
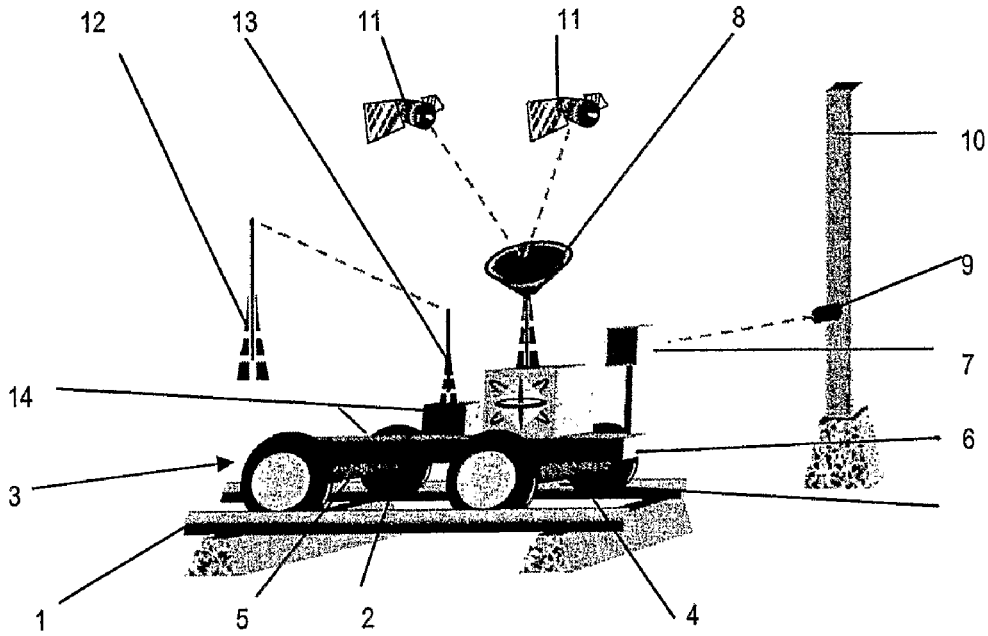
FIG. 1 is a schematic view of a measuring platform for the implementation of the method according to the invention.

FIG. 1 is a schematic view of a measuring platform 2 that can be rolled on tracks 1. Measuring platform 2 comprises a measuring bogie 3 that is equipped with two axles 4, 5. Arranged on measuring platform 2 are an inertia platform 6, an optical scanner 7 and a satellite-supported navigational system 8.

Inertia platform 6 delivers absolute position data in relation to a system of coordinates whereby first of all an initialization of inertia platform 6 must occur. During the initialization, inertia platform 6 is aligned in a known way based on the known, i.e. measured and/or detected absolute, position of measuring platform 2. Correspondingly, during the moving action of measuring platform 2 and/or measuring bogie 3 along tracks 1, inertia platform 6 delivers the respectively current position data in relation to the system of coordinates.

Usable as inertia platforms 6 are commonly known devices that operate either on a mechanical basis with a gyrostabilized platform or that are equipped with elements that are virtually free of wear and tear on the basis of lighting engineering and/or laser technology. Depending on the length of operation since the initialization and of the movements and forces applied upon inertia platform 6, the position data contain deviations from the effective position of measuring platform 2. These deviations usually increase with increased length of operation and thereby lead to faulty position-related results. This is the cause for a periodic re-initialization and/or calibration of inertia platform 6 based on known and/or measured position data of the measuring platform in order to ensure sufficiently precise position data.

The calibration can now be done, respectively, automatically in the vicinity of the fixed points 9, which are preferably arranged near track 1. For example, these can be exactly measured fixed points 9 that are entered in the survey plan of the tracks, and that are, for example, attached to upright traction pole 10. The position of measuring bogie 3 and thus of measuring platform 2 can be exactly determined by surveying in relation to such fixed points 9. Such a survey is preferably done by way of optical scanner 7 that is arranged on measuring platform 2 and/or connected thereto. In an automated state, optical scanners of this kind can deliver very precise measuring results. And based upon these measuring result, it is possible to determine in a way that is known in the art the actual absolute position of measuring bogie 3 and thus of measuring platform 2 in relation to the system of coordinates.

The deviation of the position values that is measured in such a way from the position values supplied by inertia platform 6 directly indicates the effective deviation of inertia platform 6 and can be utilized for the calibration of inertia platform 6.

In order to be able to effect a correction of the position values delivered by inertia platform 6 already between the two fixed points 9, the position of measuring platforms 2 is additionally established with the aid of satellite-supported navigational system 8. This navigational system 8 delivers parallel to inertia platform 6 also absolute position data of measuring platform 2. A deviation of the position values of inertia platform 6 and of navigational system 8 suggests a deviation of drift of inertia platform 6. When deviations of this kind occur, it is now possible to achieve a corresponding correction of the position values of inertia platform 6.

Since even satellite-supported navigational system 8 does not supply any absolutely precise position data, because the latter are dependent on the receiving quality of the signals originating from satellite 11, deviations are preferably not used at their full value but only as a certain percentage as trend value for the correction of the position data of inertia platform 6.

Figure 2:
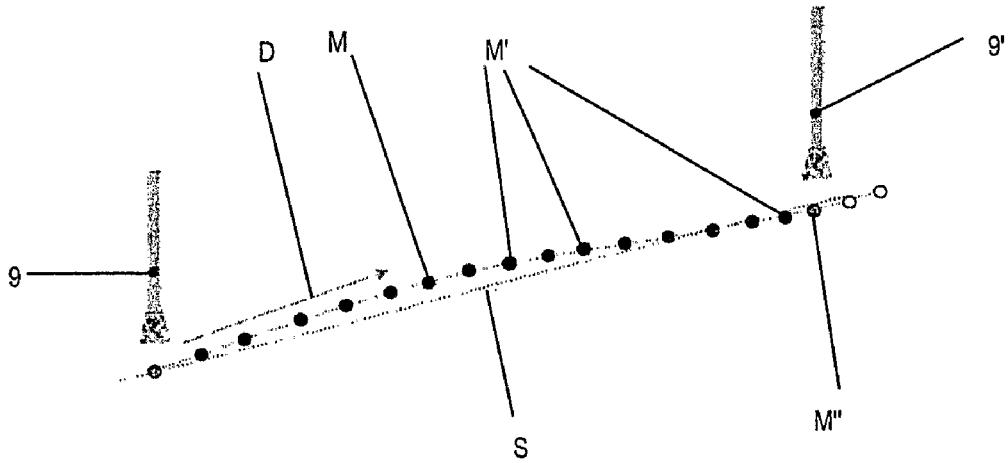
FIG. 2 is a schematic view of the course of the measuring points of the method according to the invention while incorporating a satellite-supported navigational system.

FIG. 2 is a schematic depiction of the result of this method of measuring. The desired course S of track 1 according to the survey plan is represented as a perforated line between the two fixed points 9 and 9'. The points M reflect the result of the position determination based on travel by measuring bogie 3 on the actual track course. Arrow D indicates the direction of the deviation and/or the drift of inertia platform 6, which, normally, is not directed parallel in relation to the track course. Starting at point M', a correction of the position values is now implemented based on the established differences between the position values of inertia platform 6 and satellite-supported navigational system 8 resulting in the depicted course of the position values. Preferably directly next to fixed point 9', the effective position of measuring platform 2 is now determined and a calibration of inertia platform 6 is effected. Since the position values M and/or M' already underwent a correction, wherefore the deviation from the effective position is minimized, no major deviation in relation to the previous points M' will be discernable at point M" at the calibration site.

Consequently, due to this method it is possible to achieve a very good quality of measuring points M, M' and/or M"; i.e. they reflect this actual course of track 1 with a high level of precision. The method can subsequently be used, for example, in order to create a precise survey plan of the actual position of track 1. But the data can also be used to trigger a track construction laying machine that is able to change the position of track 1 and that is able to adjust and/or correct the position of the track 1 to match the desired position in accordance to the survey plan.

To improve the precision of the position data of satellite-supported navigational system 8, it is possible to correct these data based on the measurements by an adjacent, second stationary navigational system 12 that is arranged at a defined position. This correction signal, that results from the difference of the position value determined by the second navigational system 12 and the effective position of second navigational system 12, can be fed via a receiver 13 of evaluation unit 14 to measuring platform 2, which is also where all other calculations are done and the determined values are stored and/or recorded.

Figure 3:
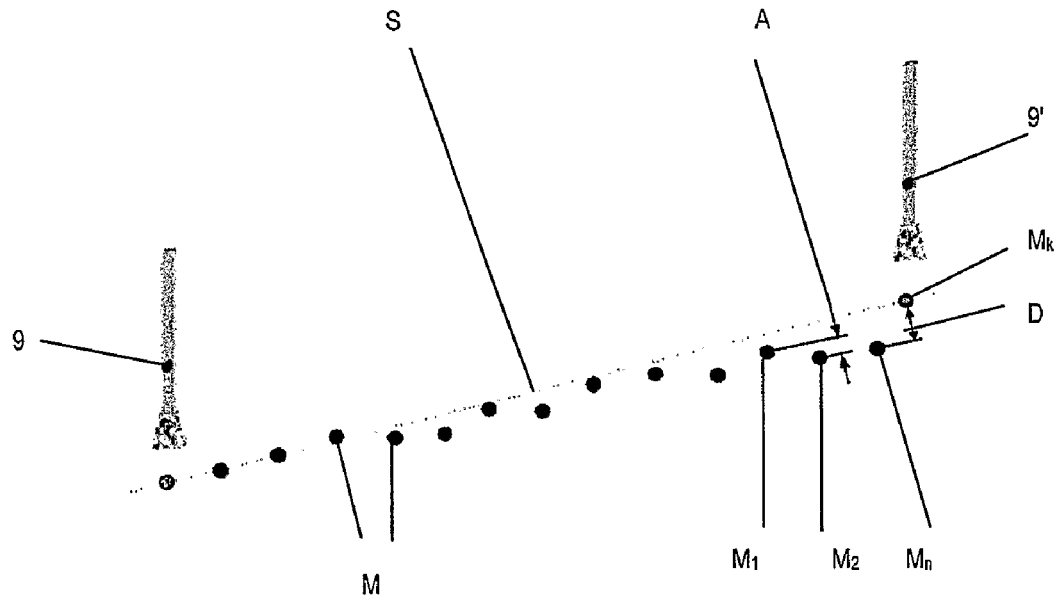
FIG. 3 is a schematic view of the course of the measuring points solely on the basis of the detection by the inertia platform.
Figure 4:
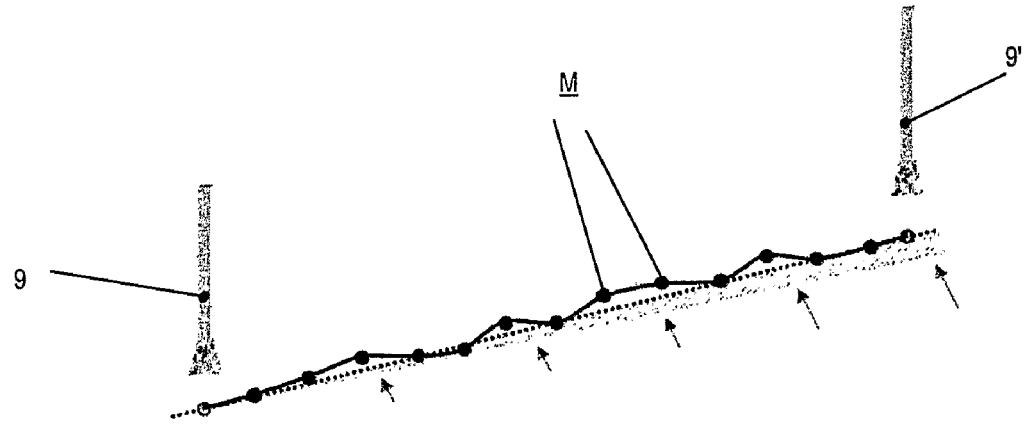
FIG. 4 is a schematic view of the corrected course of the measuring points according to FIG. 3 based on the determined deviation of the inertia platform.

FIG. 3 shows once more a schematic view of the course of the measured position data and/or of the position data corrected in accordance with the method outlined above between two fixed points 9 and/or 9'. Distance A between two sequentially arranged measuring points $M_1$ and $M_2$ in relation to desired course S represents the error and/or the deviation of the track location. Distance D between measuring point $M_n$ and calibration measuring point $M_k$ represents the accumulated deviation and/or drift of inertia platform 6. If, for example, measuring platform 2 and/or measuring bogie 3 is moved approximately with constant speed in order to record the actual track course, i.e. to do a surveying run, it can be assumed that the deviation and/or drift of inertia platform 6 between two fixed points 9 and/or 9' has been linear. Thus it is possible to correct the position values that are determined between fixed points 9 and/or 9' linearly after the fact in dependence of the distance of first fixed point 9 in correspondence to this deviation, as schematically depicted in FIG. 4. Position values $\underline{M}$ that are corrected in this manner provide a very exact image of the actual course of track 1 within the system of coordinates.

Figure 5:
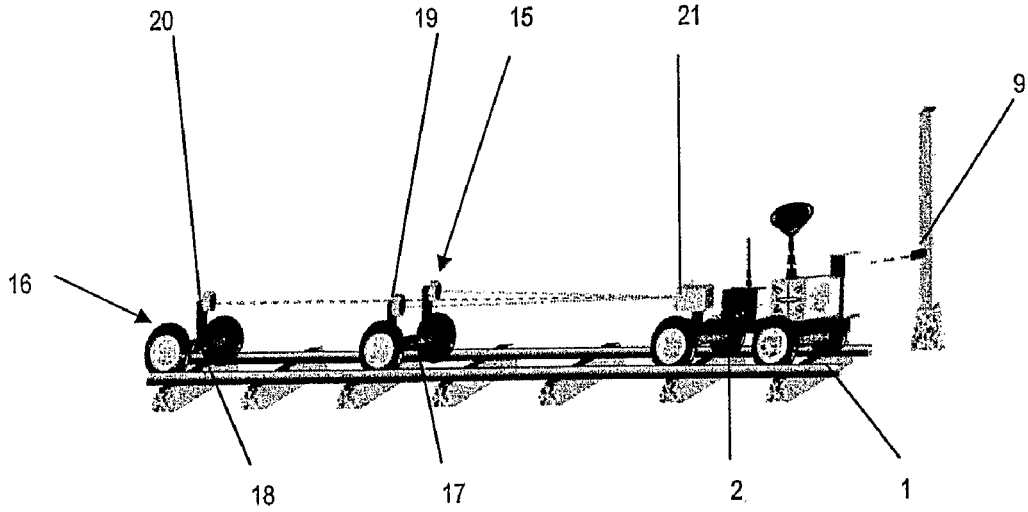
FIG. 5 is a schematic view of a measuring platform with associated reference platforms for implementing the method according to the invention.

FIG. 5 is another embodied example of a measuring bogie 3 for implementing the measuring process according to the invention. In this context, measuring bogie 3 is connected to two additional reference bogies 15 and/or 16. These reference bogies 15 and/or 16 advantageously have a reference axle 17 and/or 18 that is connected to optical reflectors 19 and/or 20. Using an optical scanner 21, it is now possible to automatically and continually measure and/or determine the relative position of reference bogie 15 and/or 16 in relation to measuring bogie 3.

Figure 6:
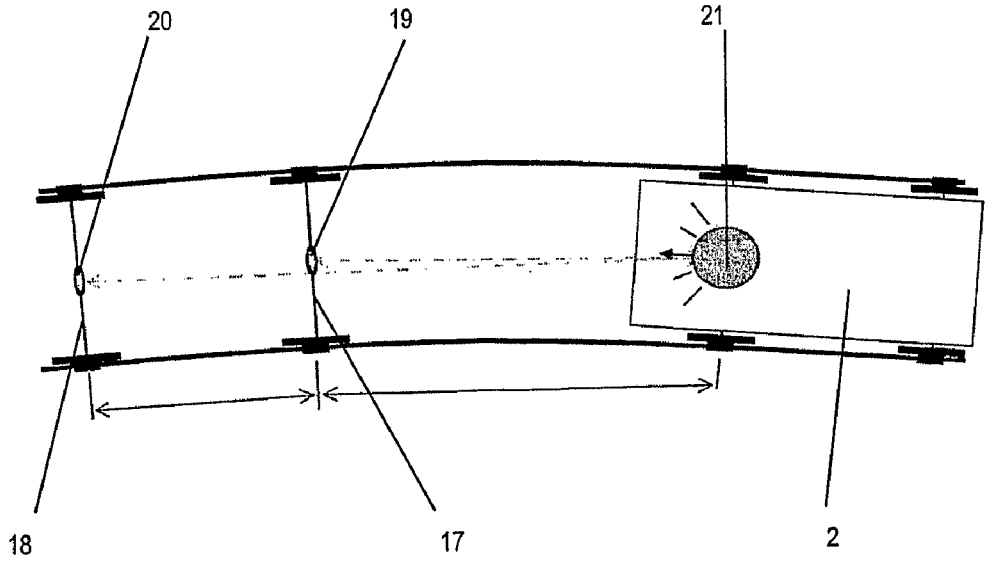
FIG. 6 is a schematic top view of a measuring apparatus according to FIG. 5 traversing a curved track.

As can be seen from the schematic top view in FIG. 6, this information, advantageously angle-related information, can, for example, serve to determine curve radius R of track 1. Since reference bogies 15 and/or 16 are connected to measuring bogie 3 at a certain known distance, it is possible to easily calculate the radius on the basis of the known geometric conditions.

It is clear to the expert is the field that the method of measuring is not limited for use in connection with railway tracks and/or tracks 1 in particular; instead, it is also suitable for use in connection with streets. In the latter case measuring bogie 3 must be rolled along the mid-line of the street, if need be manually, in order to arrive at the corresponding position values.

The invention claimed is:

1. A method for measuring tracks/roadways in relation to a survey plan of the track/roadway which contains a desired position of the track/roadway in relation to an absolute system of coordinates, and whereby a measuring platform is rolled along a track and arranged thereon is an inertia platform which is initialized and/or calibrated at the beginning of the measuring and aligned in relation to the system of coordinates, and this inertia platform detects during travel of the measuring platform the respective positions of the measuring platform in relation to the system of coordinates wherein the position data of the inertia platform are checked automatically and periodically in relation to the system of coordinates and any deviations in relation to the system of coordinates are detected as correction values and used for a correction of the measured data and/or the measured actual position of measuring platform, wherein the measuring platform is equipped with a satellite-supported navigational system, wherein position data of the inertia platform are compared to the position data of this navigational system, and whereby, when deviations are detected among this position data, corrected position data are calculated and stored as correction values.

2. The method as claimed in claim 1, wherein the position data of the satellite-supported navigational system are also checked periodically in relation to their effective position relative to the system of coordinates and undergo the corresponding corrections when deviations are detected.

3. The method as claimed in claim 1, wherein the periodic check of position data of the inertia platform is achieved via optical measuring of the position of measuring platform in relation to fixed points that are arranged adjacent to the track/roadway.

4. The method as claimed in claim 1, wherein a gyrostabilized platform or a laser platform is used as the inertia platform.

5. The method as claimed in claim 1, wherein deviations of the position data of the inertia platform that are determined at the location of a fixed point are applied linearly to previously measured points in the sense of a correction.

6. The method as claimed in claim 1, wherein the measuring platform is connected to reference platforms that are also movable and follow the course of track/roadway, and wherein their relative location in relation to the measuring platform is detected via optical means and used for the purpose of supplementing or correcting the measured and/or calculated values.

7. The method as claimed in claim 1, wherein the reference platforms are equipped with optical reflectors, and wherein at least one light scanner is used on the measuring platform.

8. The method as claimed in claim 1, for the purpose of surveying railroad tracks.

9. The method as claimed in claim 1, wherein the deviation of raw or corrected position data from the desired position is fed directly as control data for a track/roadway working machine that follows the measuring platform or that is directly connected thereto in order to adjust the track/roadway to the desired position.

10. A method for measuring tracks/roadways in relation to a survey plan of the track/roadway which contains a desired position of the track/roadway in relation to an absolute system of coordinates, and whereby a measuring platform is rolled along a track and arranged thereon is an inertia platform which is initialized and/or calibrated at the beginning of the measuring and aligned in relation to the system of coordinates, and this inertia platform detects during travel of the measuring platform the respective positions of the measuring platform in relation to the system of coordinates wherein the position data of the inertia platform are checked automatically and periodically in relation to the system of coordinates and any deviations in relation to the system of coordinates are detected as correction values and used for a correction of the measured data and/or the measured actual position of measuring platform, wherein the measuring platform is connected to reference platforms that are also movable and follow the course of track/roadway, and wherein their relative location in relation to the measuring platform is detected via optical means and used for the purpose of supplementing or correcting the measured and/or calculated values.

11. The method as claimed in claim 10, wherein the reference platforms are equipped with optical reflectors, and wherein at least one light scanner is used on the measuring platform.

12. The method as claimed in claim 10, wherein the periodic check of position data of the inertia platform is achieved via optical measuring of the position of measuring platform in relation to fixed points that are arranged adjacent to the track/roadway.

13. The method as claimed in claim 10, wherein a gyrostabilized platform or a laser platform is used as the inertia platform.

14. The method as claimed in claim 10, wherein deviations of the position data of the inertia platform that are determined at the location of a fixed point are applied linearly to previously measured points in the sense of a correction.

15. The method as claimed in claim 10, for the purpose of surveying railroad tracks.

16. The method as claimed in claim 10, wherein the deviation of raw or corrected position data from the desired position is fed directly as control data for a track/roadway working machine that follows the measuring platform or that is directly connected thereto in order to adjust the track/roadway to the desired position.

17. A method for measuring tracks/roadways in relation to a survey plan of the track/roadway which contains a desired position of the track/roadway in relation to an absolute system of coordinates, and whereby a measuring platform is rolled along a track and arranged thereon is an inertia platform which is initialized and/or calibrated at the beginning of the measuring and aligned in relation to the system of coordinates, and this inertia platform detects during travel of the measuring platform the respective positions of the measuring platform in relation to the system of coordinates wherein the position data of the inertia platform are checked automatically and periodically in relation to the system of coordinates and any deviations in relation to the system of coordinates are detected as correction values and used for a correction of the measured data and/or the measured actual position of measuring platform, wherein the deviation of raw or corrected position data from the desired position is fed directly as control data for a track/roadway working machine that follows the measuring platform or that is directly connected thereto in order to adjust the track/roadway to the desired position.

18. The method as claimed in claim 17, wherein the periodic heck of position data of the inertia platform is achieved via optical measuring of the position of measuring platform in relation to fixed points that are arranged adjacent to the track/roadway.

19. The method as claimed in claim 17, wherein a gyrostabilized platform or a laser platform is used as the inertia platform.

20. The method as claimed in claim 17, for the purpose of surveying railroad tracks.

* * * * *